US005148580A

United States Patent [19]

Dyckow

[11] Patent Number: 5,148,580

[45] Date of Patent: Sep. 22, 1992

[54] SHOWER CURTAIN SEALING AND FASTENING ARRANGEMENT

[76] Inventor: Dean W. Dyckow, 4876 St. Urbain, Montreal, Quebec, Canada, H2T 2W2

[21] Appl. No.: 723,592

[22] Filed: Jul. 1, 1991

[30] Foreign Application Priority Data

Jul. 3, 1990 [CA] Canada ..... 2020320

[51] Int. Cl.[5] ..... A44B 21/00; A47K 3/22

[52] U.S. Cl. ..... 24/303; 24/462; 160/349.2; 4/608

[58] Field of Search ..... 24/303, 304, 306, 442, 24/460, 461, 462, 72.5; 160/349.1, 349.2, DIG. 6; 4/558, 608

[56] References Cited

U.S. PATENT DOCUMENTS

| | | | |
|---|---|---|---|
| 2,303,502 | 12/1942 | Rous | 4/608 |
| 2,319,292 | 5/1943 | Boggs | 160/349.1 |
| 2,554,106 | 5/1951 | Heubeck . | |
| 2,608,250 | 8/1952 | Eyer . | |
| 2,771,945 | 11/1956 | Wittrup . | |
| 3,102,314 | 9/1963 | Alderfer | 24/303 |
| 3,205,547 | 9/1965 | Rieske . | |
| 3,282,328 | 11/1966 | Mushro et al. . | |
| 3,386,106 | 6/1968 | Clemens | 4/608 |
| 3,639,919 | 2/1972 | White . | |
| 3,808,610 | 5/1974 | Mortensen | 160/349.1 |
| 3,855,642 | 12/1974 | Blitch | 160/349.2 |
| 3,879,806 | 4/1975 | Armstrong . | |
| 3,895,399 | 7/1975 | Giarrante | 4/608 |
| 3,934,686 | 1/1976 | Simmons . | |
| 4,070,735 | 1/1978 | Canaday | 160/349.2 |
| 4,077,072 | 3/1978 | Dezura | 160/349.1 |
| 4,088,174 | 5/1978 | Edwards . | |
| 4,197,616 | 4/1980 | Panuski . | |
| 4,333,187 | 6/1982 | Schuler . | |
| 4,361,915 | 12/1982 | Siewert . | |
| 4,759,087 | 7/1988 | Beilinger | 24/462 |
| 4,944,050 | 7/1990 | Shames et al. | 160/349.2 |

FOREIGN PATENT DOCUMENTS

| | | |
|---|---|---|
| 960956 | 1/1975 | Canada . |
| 997670 | 9/1976 | Canada . |

*Primary Examiner*—Victor N. Sakran
*Attorney, Agent, or Firm*—ROBIC

[57] ABSTRACT

A kit for use to fasten the outer surface of a shower curtain to an adjacent wall in the shower closure. A sealing protrusion extends from the wall adjacent the fasteners so that, when the outer surface of the curtain is fastened to the wall, the edge of the curtain abuts the protrusion.

15 Claims, 5 Drawing Sheets

SHOWER CURTAIN SEALING AND FASTENING ARRANGEMENT

BACKGROUND OF THE INVENTION

The invention relates to a kit for sealingly and removably fastening the outer surface of at least one edge of a shower curtain of a shower enclosure to one wall of the shower enclosure. More specifically, the invention relates to such an arrangement for sealingly and removably joining the at least one edge of the shower curtain to the one wall of the shower to easily and effectively seal the enclosure.

Kits for removably joining one edge of a shower curtain to a wall of the shower enclosure are known in the art as illustrated in, for example, U.S. Pat. No. 3,808,610, Mortensen, May 7, 1974, U.S. Pat. No. 4,077,072, Dezura, Mar. 7, 1978, U.S. Pat. No. 3,205,547, Riekse, Sep. 14, 1965 and U.S. Pat. No. 4,759,087, Zeilinger, Jul. 26, 1988.

The '610 patent uses Velcro ® strips for joining the curtain edge to the wall. Additionally, it requires a rail-type arrangement to be mounted on each wall which is difficult to use.

The '072 patent also uses Velcro strips along the walls and Velcro dots for matingly joining with the Velcro strips. Because the Velcro strips and dots are not continuous, water can seep through between the edges of the curtains and the walls i.e., the arrangement does not provide a seal.

The '547 and '087 patents use rubberized mating arrangements for sealingly joining the edges of the curtains to the walls of the shower enclosure. The rubber material tends to loosen in the hot, wet, humid environment of the shower so that the life of the arrangement in the '547 patent is limited. In addition, the arrangements are difficult to operate because of the need to manipulate the insertion to seal and unseal the edge.

U.S. Pat. No. 4,333,187, Schuler, Jun. 8, 1982, teaches a shower curtain arrangement using a Velcro fastener, and U.S. Pat. No. 2,771,945, Wittrup, Nov. 27, 1956, teaches a shower curtain using a zipper fastener.

All of the kits illustrated in the patents suffer from their inability to handle water at the corner where the curtains meet the walls, i.e., at the edges of the curtains where they are removably joined to the walls.

OBJECTS OF THE INVENTION

It is therefore an object of the invention to provide a kit of the type described hereinabove, which overcomes the disadvantages of the prior art.

It is a more specific object of the invention to provide a fastening and sealing kit for sealingly and removably joining at least one edge of a shower curtain to a wall of the shower enclosure in such a manner as to fully seal this enclosure even if use is made of hand shower.

It is a still further object of the invention to provide a kit of the type described hereinabove, which further comprises corner and tub sealing pieces to completely seal the enclosure.

SUMMARY OF THE INVENTION

In accordance with the invention, there is provided a kit for use in a shower enclosure having a first wall facing a second wall, said shower enclosure being closable by a shower curtain having an inner surface facing said enclosure, an outer surface and first and second vertical edges; said kit being designed to sealingly and removably fasten at least the first edge of the shower curtain to the first wall of the enclosure, and comprising:

first fastening means mountable on said first wall, said first means being mounted on a self-fastening member mountable on said first wall and extending flat and vertically along said first wall;

second fastening means mountable on the outer surface of said shower curtain along the first edge thereof, for fastening engagement with said first fastening means; and self-fastening sealing means mountable on said first wall adjacent said first fastening means, said sealing means extending vertically near said first fastening means and comprising a protrusion mountable on said first wall inwardly of said first means with respect to the enclosure, said protrusion, projecting from said first wall toward said second wall;

whereby, in use, when said second means is in fastening engagement with said first means, said first edge of said curtain abuts said protrusion and thus is sealed by the same.

BRIEF DESCRIPTION OF THE DRAWINGS

A more detailed description of the invention will now be given, with reference to the accompanying drawings, in which.

DETAILED DESCRIPTION OF THE INVENTION

Figure 1:
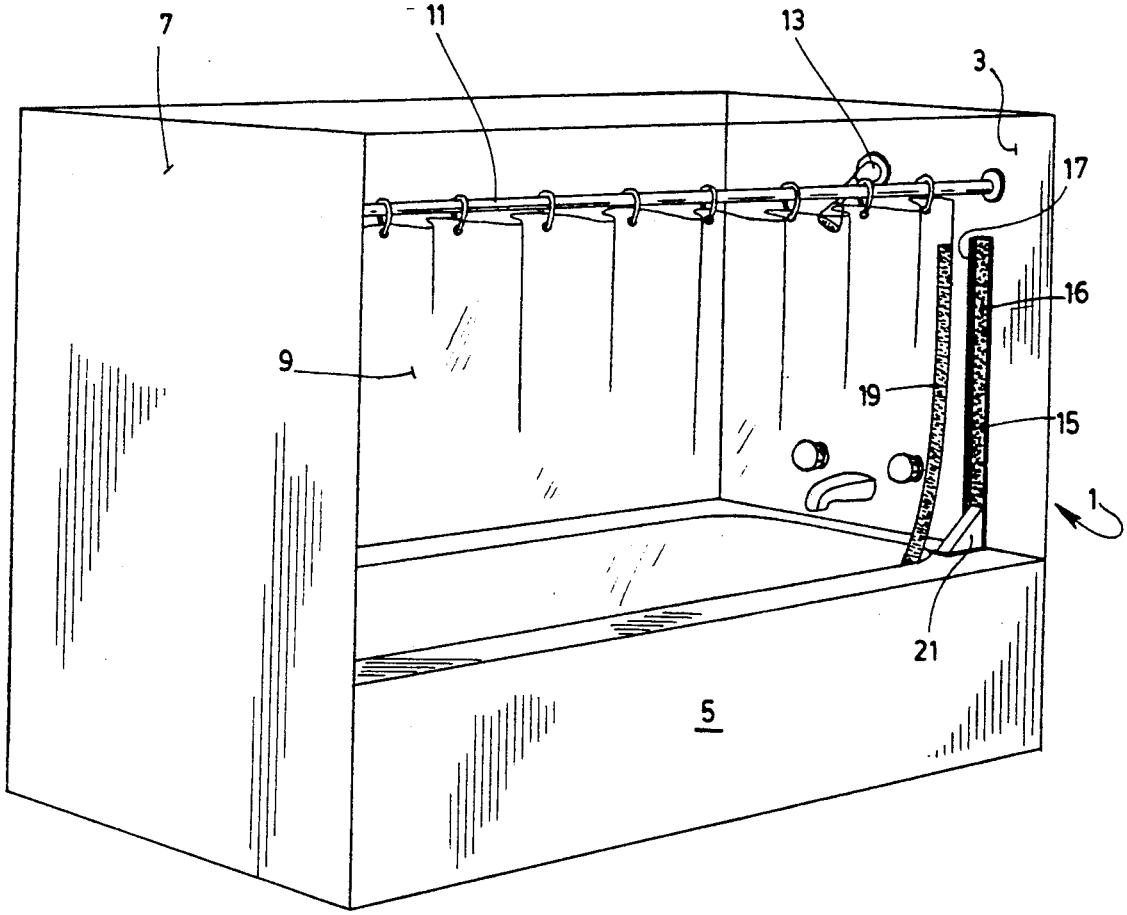
FIG. 1 is a perspective view of a shower enclosure showing one embodiment of the kit according to the invention.

FIG. 1 shows a shower enclosure, illustrated generally at 1, comprising a first wall 3 at one end of a bathtub 5. Spaced from the first wall at the other end of the bathtub 5 is a second wall 7. Shower curtain 9, mounted on a shower rod 11, is extendable between the walls 3 and 7. A shower head 13 is mounted on the first wall 3.

Extending vertically along the first wall 3 is a fastening and sealing means 15 comprising a first member 16 and a second member 17. The first member comprises a fastening means which may be, for example a strip of a male and female fabric fastener such as VELCRO ®, a set of magnets of opposite polarities, or structures of a similar nature. The sealing means 17 comprises a protrusion which protrudes from the first wall 3 in the direction of the second wall 7. It can be seen that the sealing means 17 is disposed inwardly of the fastening means 16.

Disposed on the outer surface of curtain 9 is a fastening means 19 which interacts with the fastening means 16 on the wall 3. Thus, if the fastening means 16 is a Velcro strip of the first type, then the fastening means 19 will be a Velcro strip of the second type. Alternatively, if the fastening means 16 comprises a magnet of a first polarity, then the fastening means 19 will comprise a magnet of a second polarity.

Figure 1A:
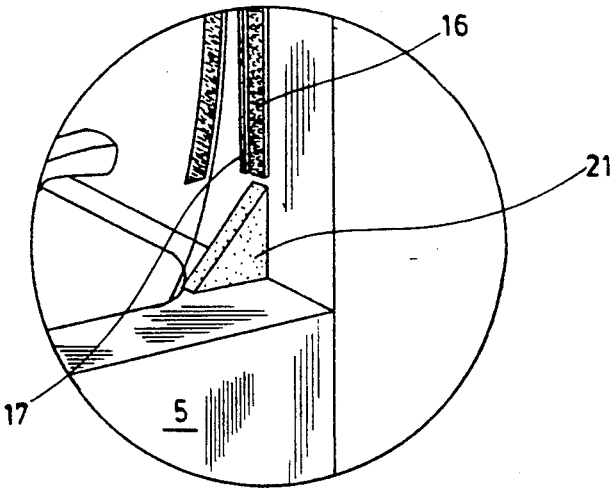
FIGS. 1B and 1C illustrate alternative embodiments of a corner piece.
Figure 1B:
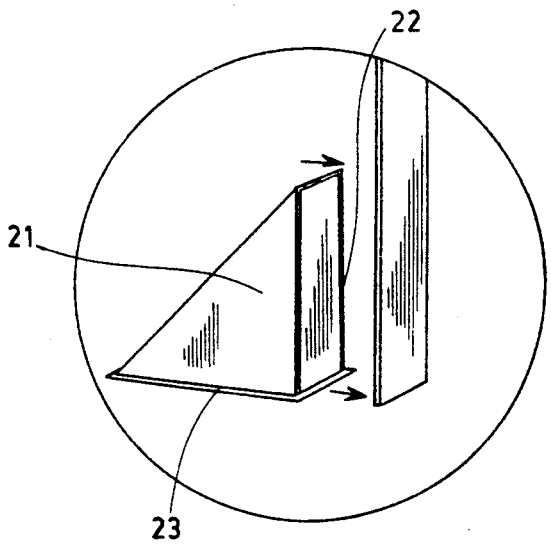
Figure 1C:
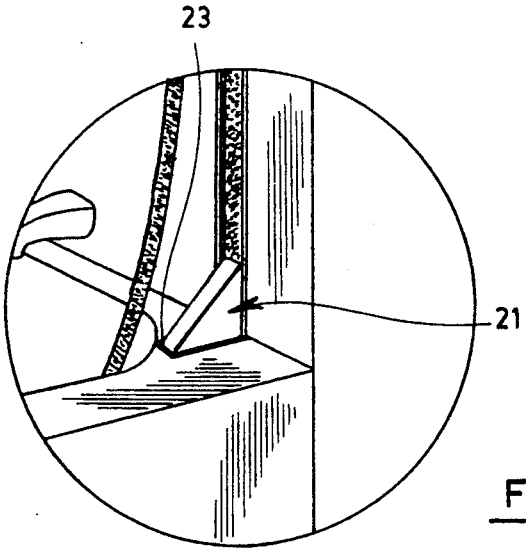

Mounted adjacent the wall 3 and at the bottom of the sealing and fastening means 15 may be disposed a corner piece 21. In FIG. 1A, the corner piece is made of a water absorbing material, for example, a sponge. In FIGS. 1B and 1C, the corner piece is made of plastic material and is provided with self-fastening means such as a magnet 22 which allows it to be fastened to the fastening means 16 (FIG. 1B) or to the upper edge of the tub (FIG. 1C). In all these embodiments, the corner piece may be extended along the tub to form a tub sealing piece and may comprise a skirt 23 or any similar sealing means to contain water in the tub area.

Figure 6:
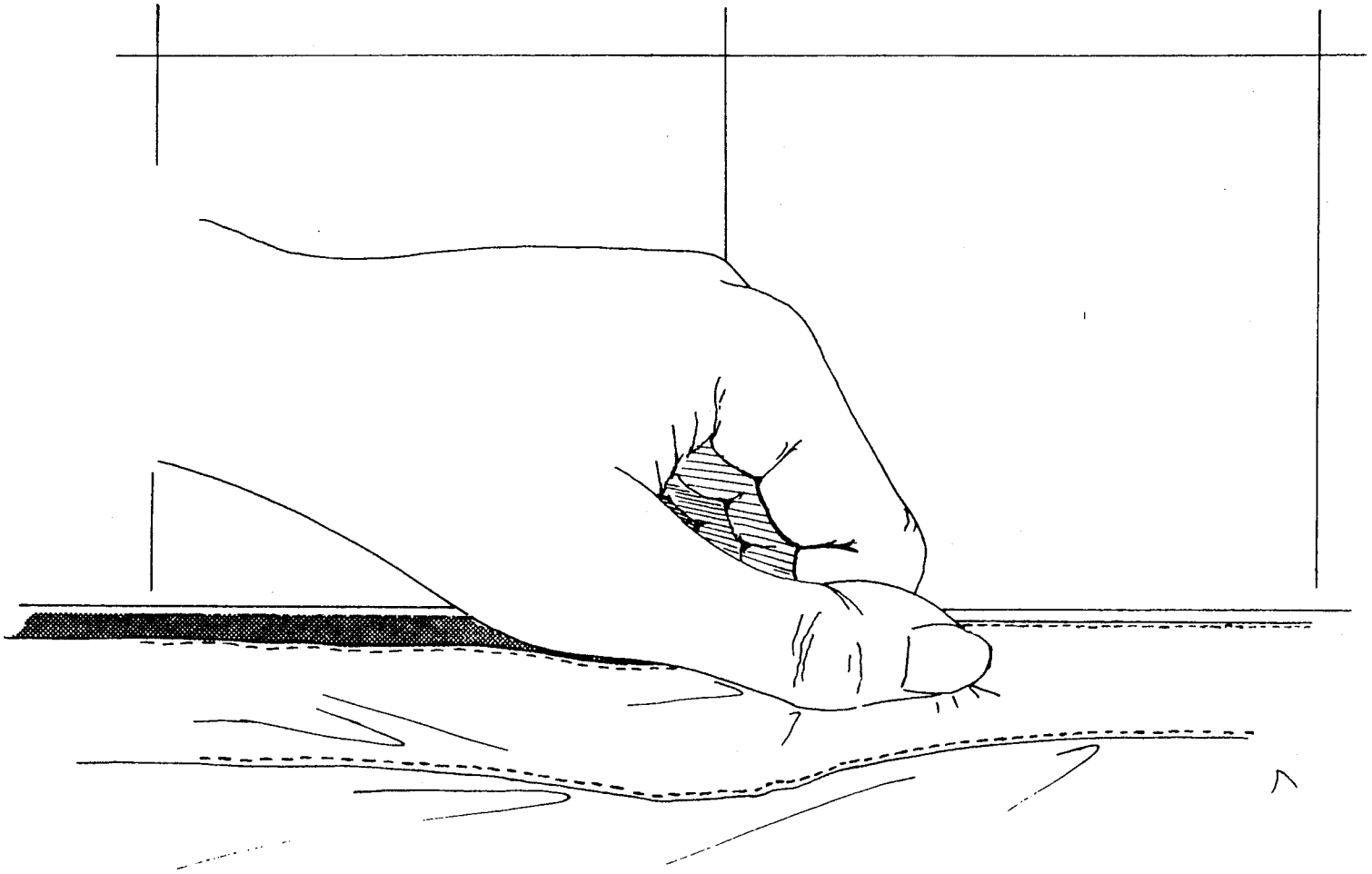
FIG. 6 illustrates how the protrusion is used as a guide to align the curtain edge in accordance with the embodiment of the invention as shown in FIG. 1.

In operation, a person taking a shower would first step into the tub and draw the first edge of the curtain, containing the strip 19, towards the wall 3. He will then line the strip 19 with strip 16 using the protruding edge 17 as a guide to accurately and asthetically align the curtain 9 as shown in FIG. 6. The fastening means of 16 and the fastening means of 19 will then interact to fasten the outer surface of the first edge of the shower curtain against the first wall 3, and the protrusion 17 will act as a seal so that the edge of the curtain will be sealingly and removably joined to the first wall 3.

A similar approach may be taken at the other edge of the shower curtain to form a sealed seam at the other end of the curtain. The edges of the shower curtain may then be attached to respective ones of the corner pieces by, for example, Velcro means, magnetic means or the like.

With this kit, water cannot escape between the wall and the edge of the shower curtain in view of the sealed seam formed at the edges. Water at the corners will either be absorbed, when using a sponge, or will be contained in the designated enclosure area, when use is made the corner pieces provided with a seal 23 as illustrated in FIGS. 1B and 1C. Accordingly, the floor of the bathroom in which the shower enclosure is used will not get wet due to water escaping from the shower through the space between the curtains and the wall or from poorly designed tubs that allow pools of water to gather and flow on the floor. It is noted that the absorbing corner piece 21 is also designed to contain any water which may leak from pools that would otherwise gather at the top of the tub container and flow onto the floor.

It is noted that some never, more modern bathtubs may not permit shower water to pool and leak from the top of the tub's contour because of their design or because of the manner in which they are installed. In such a case, as will be obvious, the corner pieces 21 are not required and the arrangement as taught herein would alone seal the enclosure.

Figure 2:
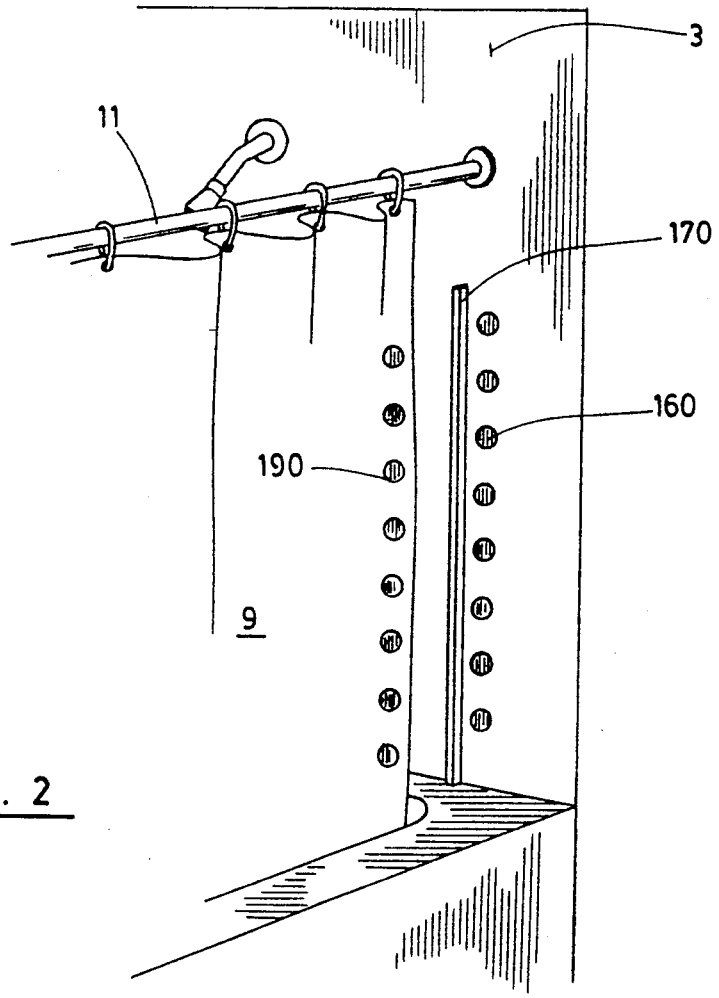
FIG. 2 is a perspective view of another embodiment of the kit according to the invention.

Although in FIG. 1 the fastening means 16 is formed integrally with the sealing means 17, FIG. 2 illustrates an embodiment wherein the fastening means 160 are formed separately from the sealing means 170. In FIG. 2, the fastening means comprise a vertical row of circles which may be circles of Velcro material or circles of magnetic material or the like. The protrusion 170, which also extends vertically, is connected directly onto the wall 3.

The interacting fastening means on the first edge of the curtain 9 comprise a similar row of circular members 190 which, once again, may be Velcro material or magnetic means. It is also pointed out that, both in the FIG. 1 embodiment and in the FIG. 2 embodiment, if the fastening means mounted on the first wall 3 is Velcro material of a first kind, then the fastening means mounted on the outer surface of the curtain would constitute Velcro material of a second kind. Alternatively, if the fastening means mounted on the wall are magnetic means of a first polarity, then the interacting fastening means mounted on the outer surface of the curtain would constitute magnetic means of a second polarity.

Figure 3:
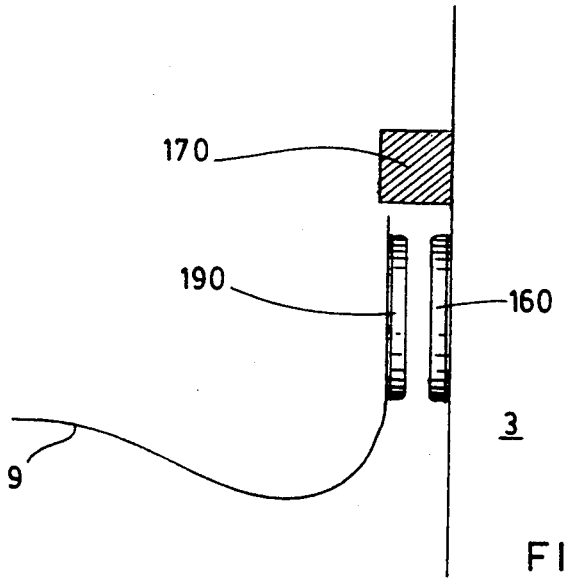
FIG. 3 is a top plan view showing how a sealed seam is formed at the edge of the shower curtain when use is made of the kit shown in FIG. 2.

As seen in FIG. 3, when the means 160 engage the means 190, the edge of the curtain 9 abuts the protrusion 170 so that once again, the curtain 9 is removably and sealingly joined to the wall 3. Obviously, the circular row 160 could be replaced by elongated strip(s) as in FIG. 1, in which case, the circular row 190 could also be replaced by corresponding elongated strip(s).

Figure 4:
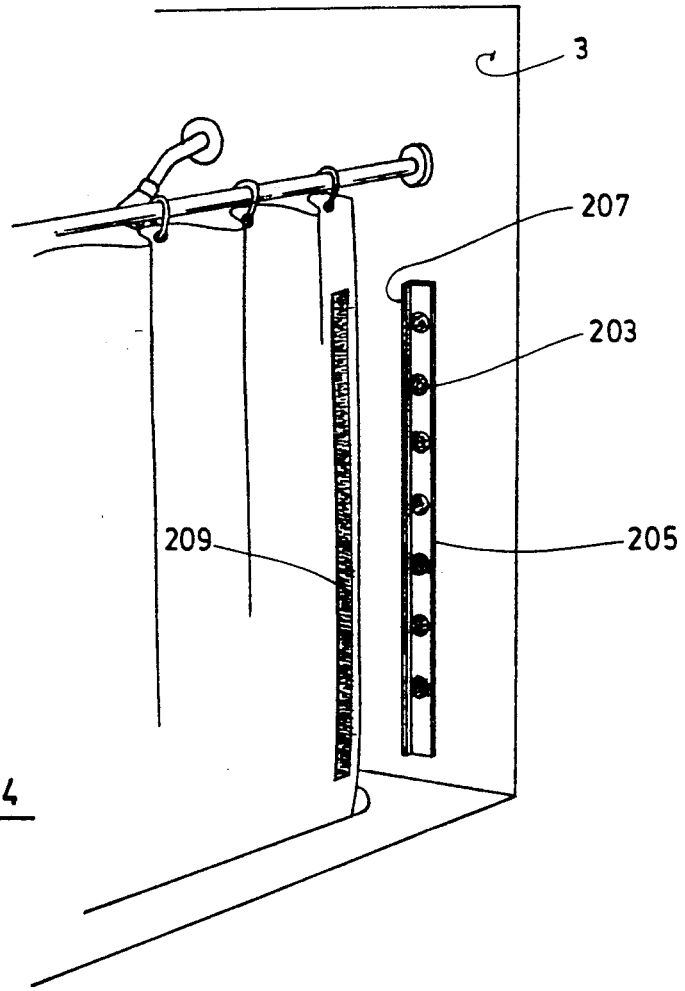
FIG. 4 is a perspective view of a further embodiment of the kit according to the invention.

As shown in FIG. 4, the elongated strip 16 shown in FIG. 1 may be replaced by a row of circles 203 and the fastening means on the outer surface of the shower curtain may or may not also be replaced by a row of circles 209. The row of circles 203 is mounted on a mounting means 205 integrally joined to a protrusion 207. It would also be possible to combine an elongated strip with a circular row, i.e., the circular strip on the curtain and an elongated strip on the wall.

Figure 5:
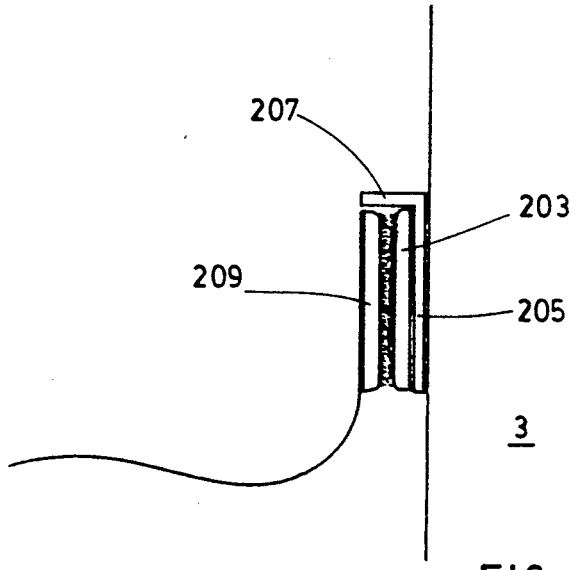
FIG. 5 is a top plan view showing how a sealed seam is formed at the edge of the shower curtain when use is made of the kit shown in FIG. 4.

In FIG. 4, the mounting means 205, consist of an elongated strip, mounted on the wall 3. Once again, when the means 205 engage the means 209, the edge of the curtain 9 abuts the protrusion 207 so that the curtain 9 is removably and sealingly joined to the wall 3 as is shown in FIG. 5.

Once again, the circles 203 on the mounting strip 205 may be Velcro material of a first kind, whereas the circles 209 on the outer surface of the shower curtain 209 may be Velcro of a second kind, and vice versa. As will be apparent from FIGS. 4 and 5, the protrusion 207 is in the same position relating to the tub as the protrusion 17 shown in FIG. 1.

Although several embodiments have been described, this was for the purpose of illustrating, but not limiting, the invention. Various modifications, which will come readily to the mind of one skilled in the art, are within the scope of the invention as defined in the appended claims.

What is claimed is:

1. A kit for use in a shower enclosure having a first wall facing a second wall, said shower closure being closable by a shower curtain having an inner surface facing said enclosure, an outer surface and first and second vertical edges; said kit being designed to sealingly and removably fasten at least the first edge of the shower curtain to the first wall of the enclosure, and comprising:

first fastening means mounted on an elongated self-fastening member mountable on said first wall, said first fastening means extending flat and vertically along said first wall when said self-fastening member is mounted;

second fastening means mountable on the outer surface of said shower curtain along the first edge thereof for fastening engagement with said first fastening means, said second fastening means extending flat on said outer surface and thus causing said shower curtain adjacent said first edge to be folded toward said enclosure and extend flat onto said first wall when said first and second fastening means are engaged; and self-fastening sealing means mountable on said first wall adjacent said first fastening means, said sealing means, when mounted, extending vertically near said first fastening means over the length of said self-fastening member, and comprising a protrusion projecting from said first wall toward said second wall inwardly of said first fastening means with respect to the enclosure;

whereby, in use, when said second means is in fastening engagement with said first means, said first edge of said curtain abuts said protrusion and thus is sealed by the same.

2. A kit according to claim 1, wherein said self-fastening member is in the form of a self-fastening strip fixable on the said wall.

3. A kit according to claim 2, wherein said first fastening means comprises a male and female fastener material of a first kind, and wherein said second fastening means comprises a male and female fastener material of a second kind.

4. A kit according to claim 2, wherein said first fastening means comprises magnets of a first polarity and said second fastening means comprises magnets of a second polarity.

5. A kit according to claim 4, wherein said water-absorbing material is a sponge.

6. A kit according to claim 2, wherein said mounting strip and said protrusion are integrally formed.

7. A kit according to claim 3, wherein said first fastening means comprises a male and female fastener material of a first kind, and wherein said second fastening means comprises a male and female fastener material of a second kind.

8. A kit according to claim 3, wherein said first fastening means comprises magnets of a first polarity and said second fastening means comprises magnets of a second polarity.

9. A kit according to claim 6, wherein said corner piece also includes self-fastening means.

10. A kit according to claim 1, wherein said first fastening means comprises a male and female fastener material of a first kind, and wherein said second fastening means comprises a male and female fastener material of a second kind.

11. A kit according to claim 1, wherein said first fastening means comprises magnets of a first polarity and said second fastening means comprises magnets of a second polarity.

12. A kit according to claim 1, for use in a shower enclosure incorporating a bath tub, wherein said kit further comprises at least one corner piece including a seal to contain water in said bath tub, said corner piece being mountable adjacent said first wall and said bath tub, at the bottom of said first fastening means.

13. A kit according to claim 1, for use in a shower enclosure incorporating a bath tub, wherein said kit further comprises at least one corner piece made of a water-absorbing-material said corner piece being mountable adjacent said first wall and said bath tub, at the bottom of said first fastening means.

14. A kit according to claim 1, for use in a shower enclosure incorporating a bath tub, wherein said kit further comprises a tub sealing piece to contain drifting or falling water in or on the said bath tub, said sealing piece being mountable adjacent said first wall and said bath tub, at the bottom said first fastening means.

15. A kit for sealingly and removably fastening a vertical edge of a shower curtain having an outer surface to a vertical wall adjacent said vertical edge, said kit comprising:

an elongated self-fastening mounting strip mountable vertically along said wall;

first fastening means mounted on said mounting strip so as to extend flat onto said wall when said mounting strip is mounted;

sealing means comprising a protrusion integrally formed with said mounting strip adjacent said first fastening means, said sealing means projecting from said mounting strip and extending along side said first fastening means; and self-fastening, second fastening means mountable on the outer surface of said shower curtain along the vertical edge thereof, for fastening engagement with said first fastening means, said second fastening means extending flat on said outer surface and thus causing the shower curtain adjacent the vertical edge to be folded and extend flat on the wall when the first and second means are engaged, with the vertical edge extending close to the sealing means.

* * * * *